US005385519A

United States Patent [19]

Hsu et al.

[11] Patent Number: 5,385,519

[45] Date of Patent: Jan. 31, 1995

[54] RUNNING MACHINE

[76] Inventors: Chi-Hsueh Hsu; Chih-Yes Shyu; Jong-Yes Shyu, all of 4F, No. 144, Chu-Lin Road, Yung-Ho Shih, Taipei Hsien, Taiwan, Prov. of China

[21] Appl. No.: 229,706

[22] Filed: Apr. 19, 1994

[51] Int. Cl.[6] ..... A63B 21/00; A63B 22/02

[52] U.S. Cl. ..... 482/54; 482/51; 482/57; 482/902

[58] Field of Search ..... 482/900, 901, 902, 51, 482/52, 53, 54, 57, 74

[56] References Cited

U.S. PATENT DOCUMENTS

| | | | |
|---|---|---|---|
| 4,278,095 | 7/1981 | Lapeyre | 482/901 |
| 4,408,613 | 10/1983 | Relyea | 482/901 |
| 4,542,897 | 9/1985 | Melton et al. | 482/902 |
| 5,162,029 | 11/1992 | Gerard | 482/54 |
| 5,205,800 | 4/1993 | Grant | 482/54 |
| 5,240,417 | 8/1993 | Smithson et al. | 482/902 |

*Primary Examiner*—Stephen R. Crow
*Attorney, Agent, or Firm*—Morton J. Rosenberg; David I. Klein

[57] ABSTRACT

A running machine is provided. The machine includes a base consisting of a flat upper plate and flat lower plate, a plurality of roller shafts provided laterally and spaced above the upper plate. An endless belt moves around the roller shafts by means of a motor. Four lifts are provided between the upper plate and the lower plate at the respective four corners thereof, to incline the upper plate. A computer for controlling the motor and the lifts is also provided. The computer controls the motor and lifts according to a program provided on a disk recorded with a program of various conditions of a rod. A visual-acoustic mask is connected to the computer, and includes a screen and a speaker to present images and sounds according to the program to a user wearing the mask while running on the belt for exercise.

1 Claim, 7 Drawing Sheets

RUNNING MACHINE

BACKGROUND OF THE INVENTION

A conventional running machine only allows a user to run thereon to exercise indoors. It is only possible to adjust the speed of the moving belt of such machines, and is quite monotonous for the user.

SUMMARY OF THE INVENTION

This invention has been devised to offer a running machine combined with a computer and a visual-acoustic mask for a user to wear while running on a moving belt of this machine. Using the mask, the user can look at a display of a road or of the ground, shown on a screen, and at the same time hear sounds associated therewith from a speaker in the mask. The user may thus feel as if he/she is really running on the road.

This running machine includes a base consisting of a flat upper plate and a flat lower plate. Four lifts are provided between the upper plate and the lower plate to lift the front end or rear end of the upper plate to incline the upper plate. A plurality of roller shafts are provided laterally and spaced above the upper plate with an endless belt being provided around the roller shafts and moved by a motor so a user can run thereon.

The motor and the lifts are controlled by a computer programmed from a disk which is recorded with a program of various conditions of a road. The motor and the lifts are controlled to move the belt and to incline the upper plate carrying the belt according to the program of the disk. Then a visual-acoustic mask is connected with the computer, having a screen to show images and a speaker to provide sounds according to the program, so that a user wearing the mask may look at the images of a road and hear the sounds of the road while running on the endless belt.

BRIEF DESCRIPTION OF THE DRAWINGS

The invention will be better understood by reference to the accompanying drawings, wherein.

DESCRIPTION OF THE PREFERRED EMBODIMENTS

A running machine in the present invention, as shown in 1, includes a base 1, a computer 2, and a visual-acoustic mask interconnected with each other.

Figure 2:
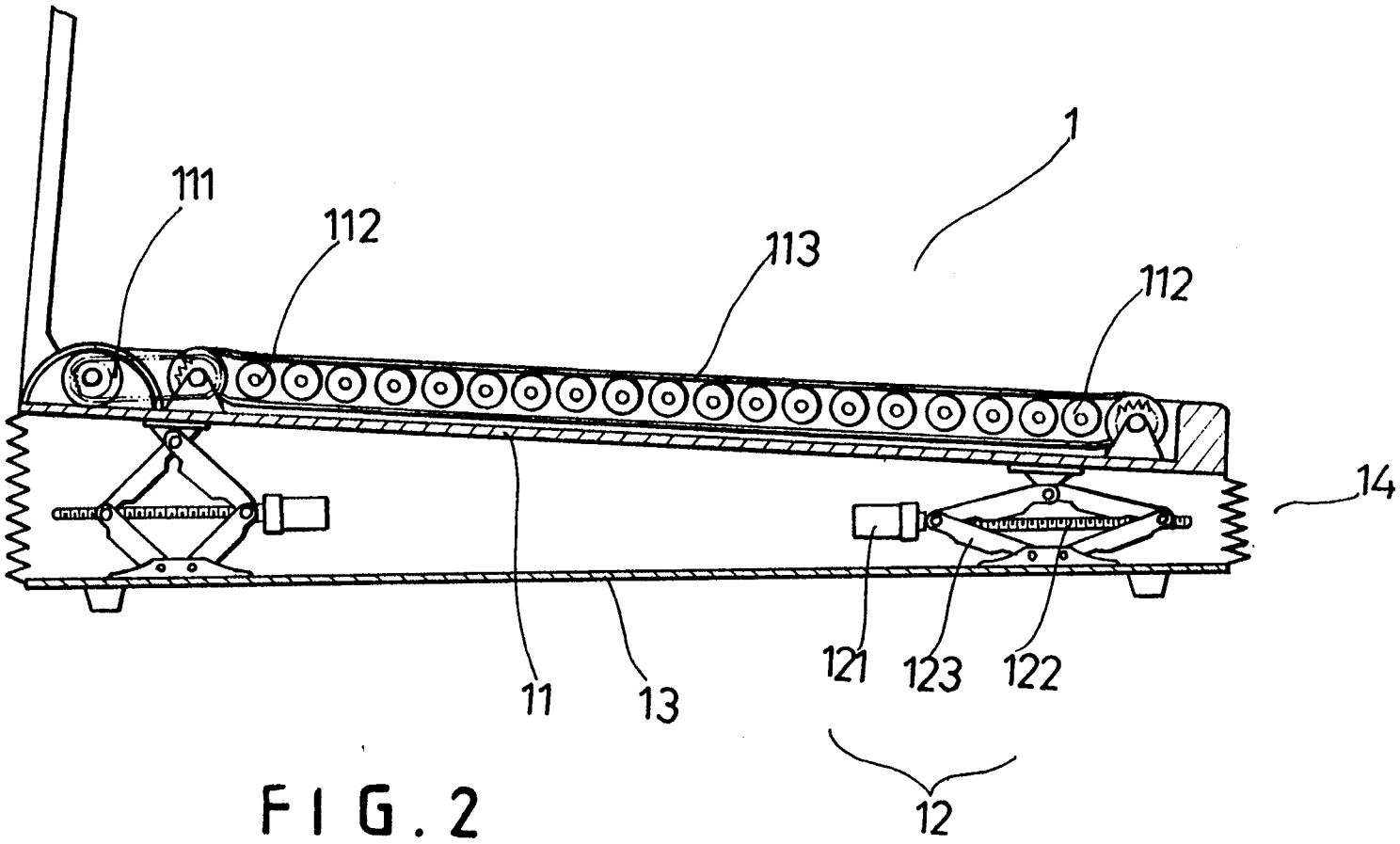
FIG. 2 is a side cross-sectional view of a base of the running machine of the present invention.
Figure 3:
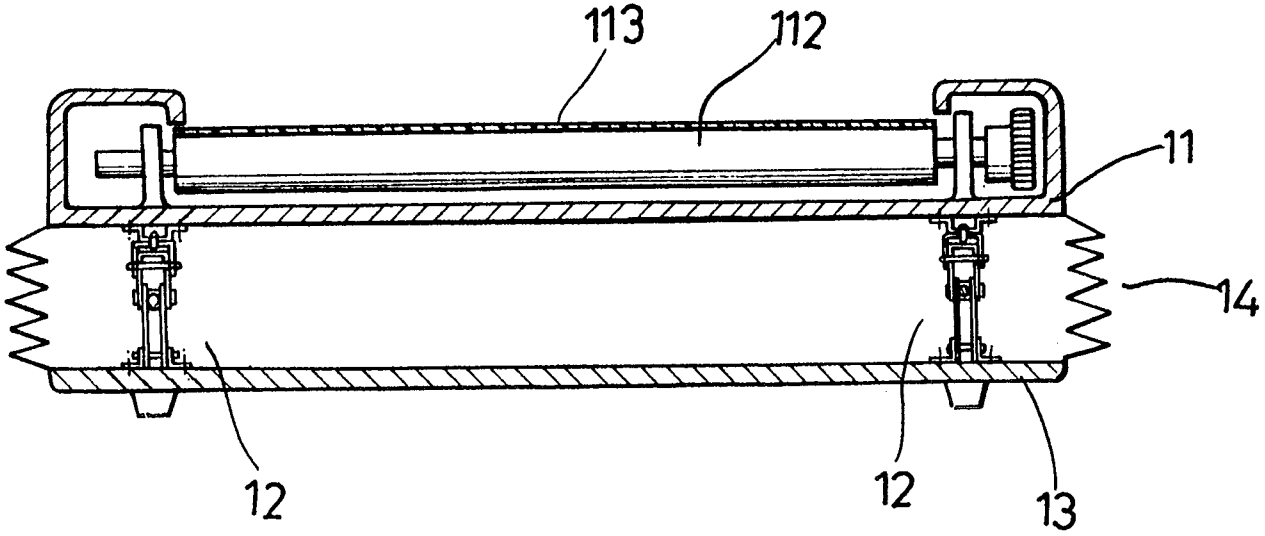
FIG. 3 is a front cross-sectional view of the base of the running machine of the present invention.

Referring to FIGS. 2 and 3, there is shown, the base 1 consisting of a flat upper plate 11, a lower plate 13, a motor 111, a plurality of roller shafts 112, and an endless belt 113 placed around the roller shafts 112. Four lifts 12 are also provided at the four corners of the base between the flat upper plate 11 and the flat lower plate 13. Each lift 12 includes two pairs scissor-shaped arms 123 connected with an moved by a threaded rod 122 rotated by a motor 121. A bellow 14 is provided between the flat upper plate 11 and the flat lower plate 13 so as to enable the flat upper plate 11 to move up and down relative to the flat lower plate 13 while preventing dirt from entering the space between both the plates 11, 13.

Figure 1:
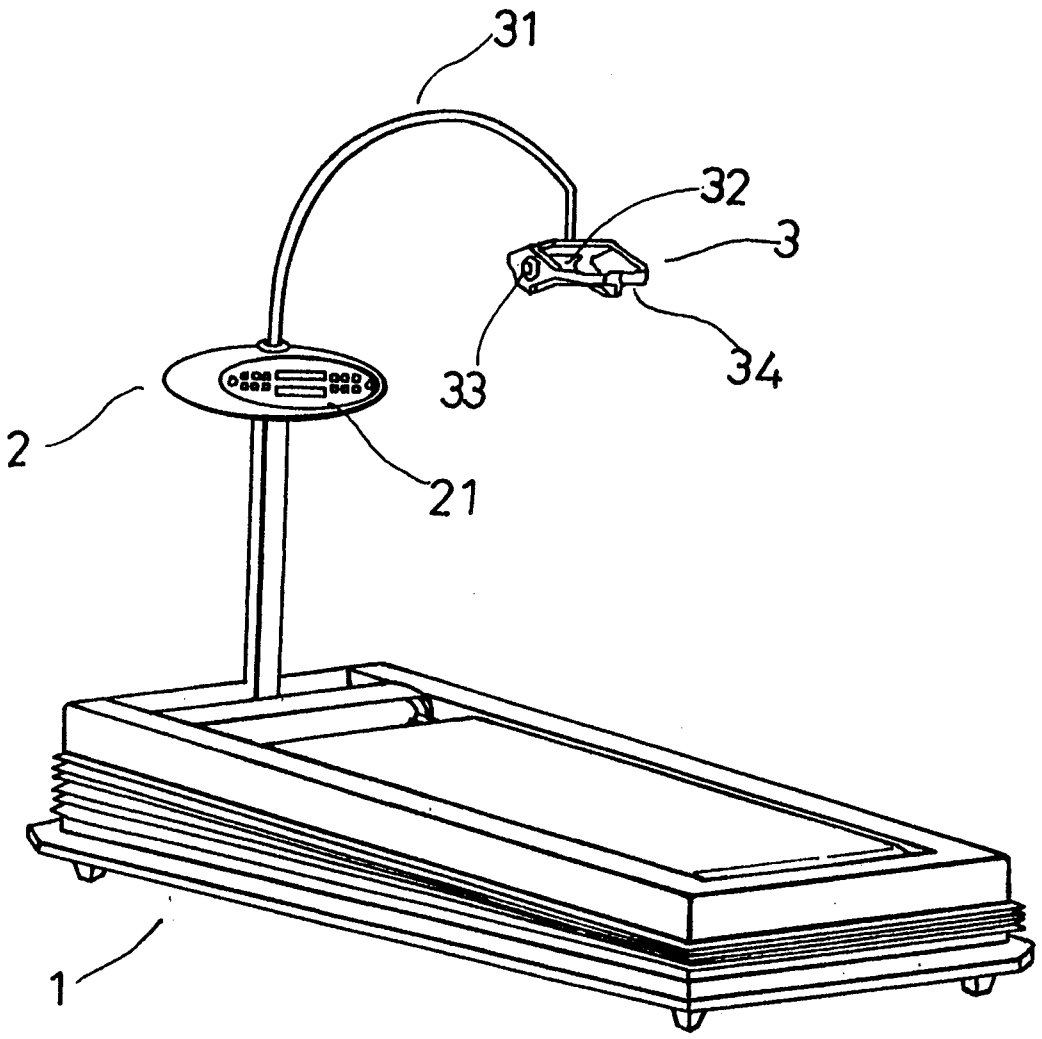
FIG. 1 is a perspective view of a running machine of the present invention.

The computer 2, as shown in FIG. 1, is deposited properly a front portion of the base 1, for controlling the operation of the motors 111, 121. The computer 2 has an indicating panel 21 for showing all the information concerning operation of the motors 111, 121.

The visual-acoustic mask 3 is connected to the computer 2 by means of a flexible tube 31 and controlled by the computer 2. The mask 3 has a screen 32, a loud speaker 33 at both sides of the screen 32 and a band 34 for securing the mask 3 on the head of a user of the machine.

Figure 4:
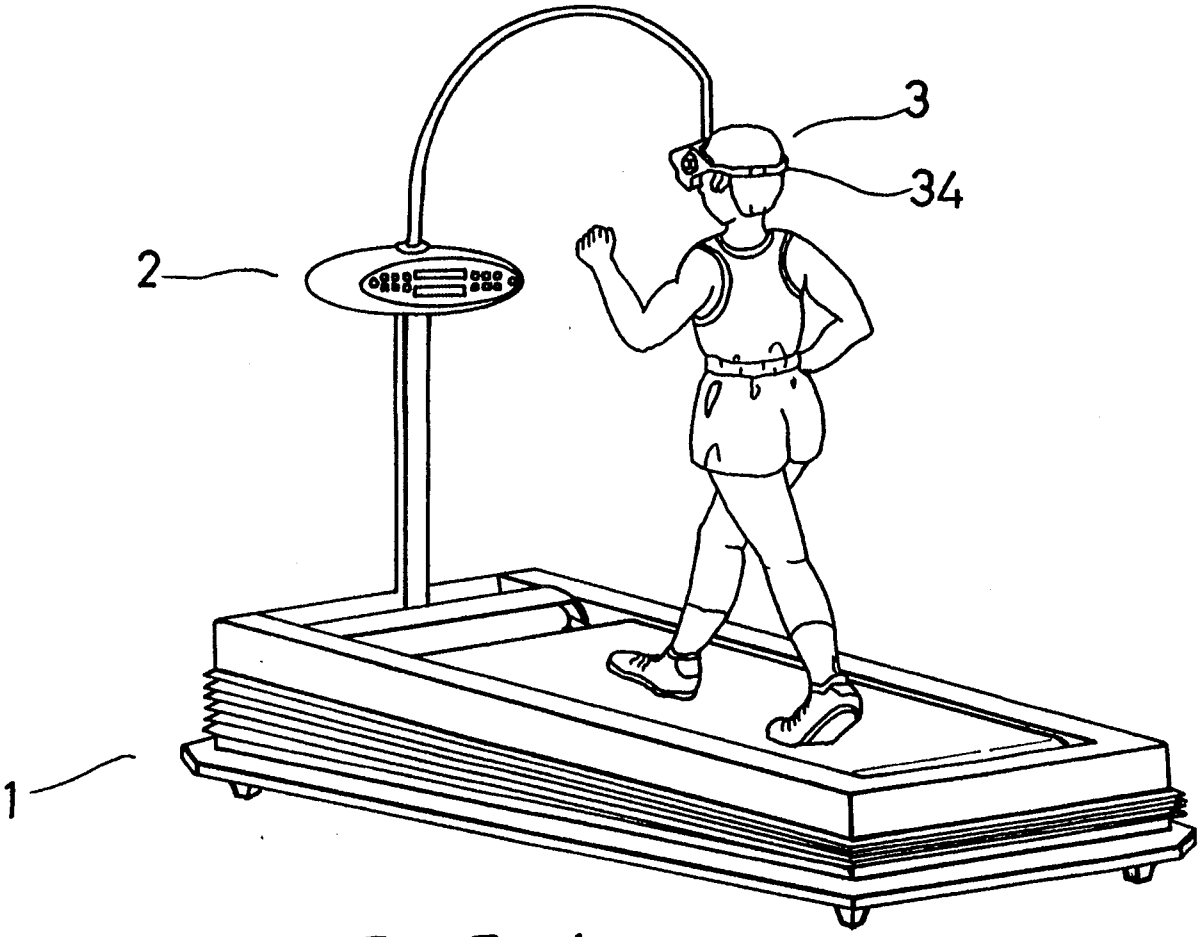
FIG. 4 is a perspective view of the running machine with a user standing thereon of the present invention.
Figure 5:
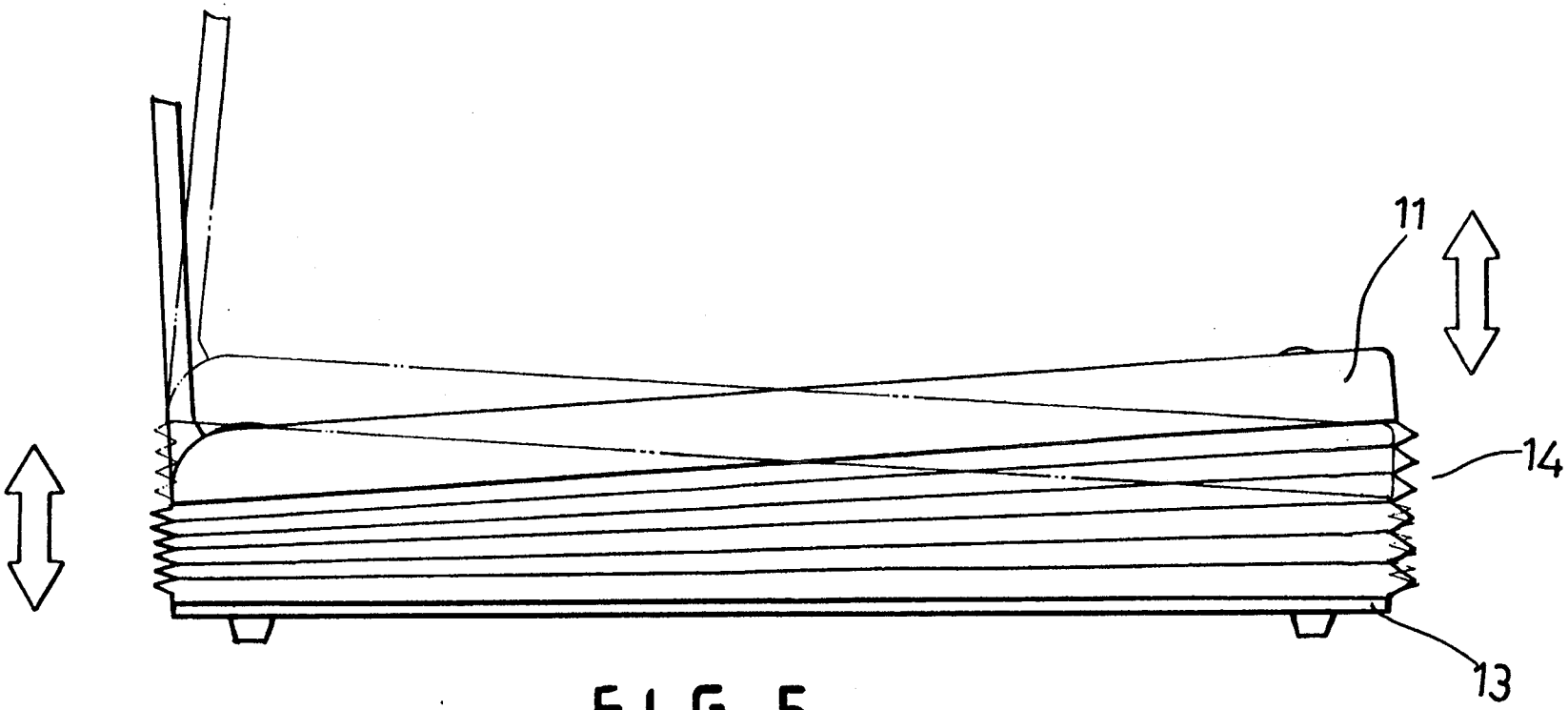
FIG. 5 is a side view of a flat upper plate, the flat lower plate and a bellows in the running machine of the present invention, showing the upper plate being lifted up or down to be inclined forward or backward.

As shown in FIG. 4, a disk recorded with a program of various road conditions and sounds is insertable into the disk drive of the computer 2. Subsequently the computer 2 is initiated to transmit, according to the program, images and sounds to the screen 32 and the loud speakers 33, respectively, of the visual-acoustic mask 3, and also to operate the motor 111 to move the belt 113 for a user to run thereon. When a sloped section of the road appears on the screen 32, the lifts 12 can, at the same time, be operated to slope the moving belt 113 up or down according to the program. This presents various road conditions to which the user must adapt.

As described above, a user of this machine not only trains by running in accordance with movement of the belt 113, but also sees a programmed road condition shown on the screen 32 and hears sounds of the road through the speakers 33, as well. The user may thus feel as if he/she might be running on a real road, as the flat upper plate 11 carrying the belt 113 may slope up or down in accordance with the image on the screen. The user will thereby have a pseudo-real feeling of outdoor running.

Figure 6:
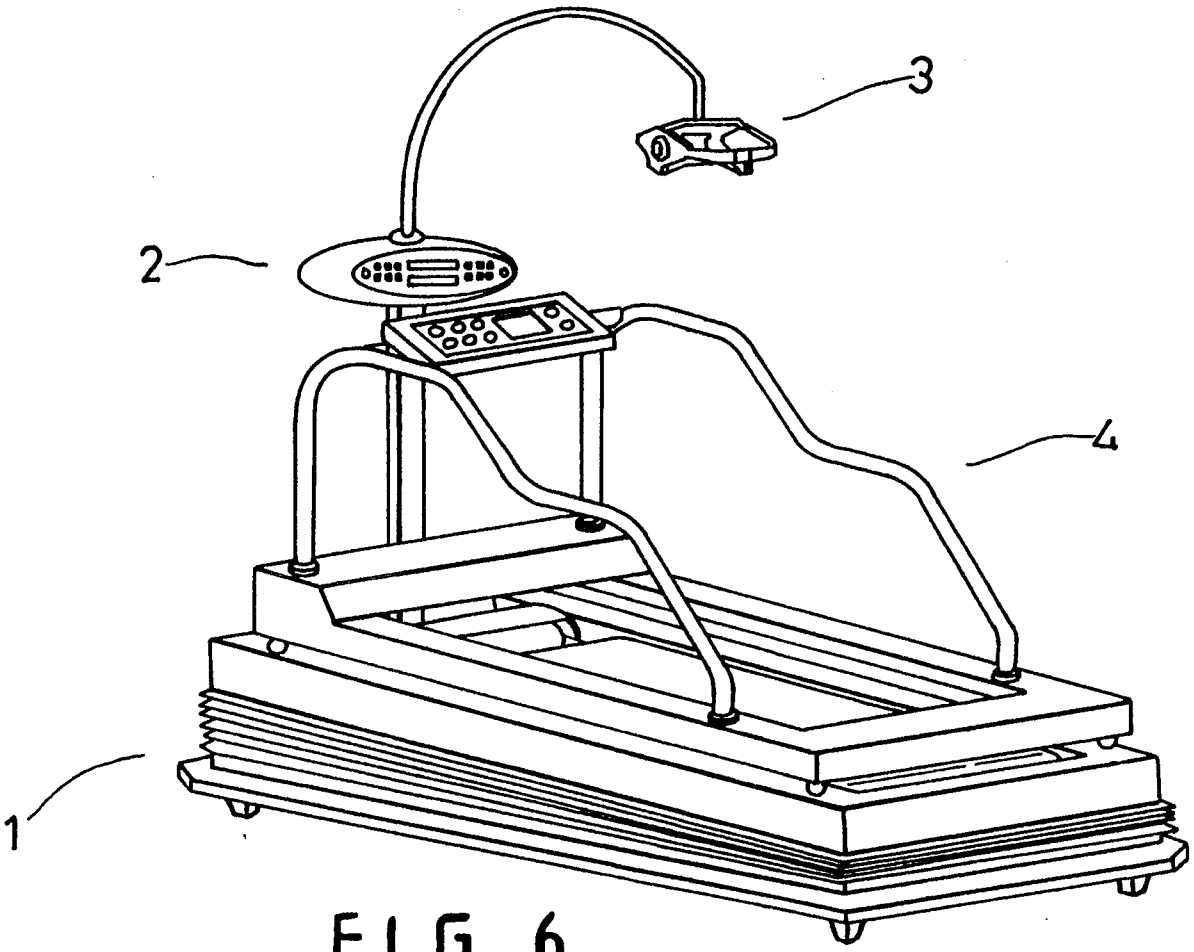
FIG. 6 is a perspective view of an embodiment of the running machine of the present invention wherein the base is combined with a conventional running machines; and, FIG. 7 is a perspective view of another embodiment of the running machine of the present invention wherein the base is combined with a conventional pedaling bench.

FIG. 6 shows a conventional running machine fixed firmly on the base 1 of this running machine to make use of the visual-acoustic mask with the conventional running machine for training by running under an on-the-spot condition coming from the screen 32 and the speakers 33 of the visual-acoustic mask 3.

Figure 7:
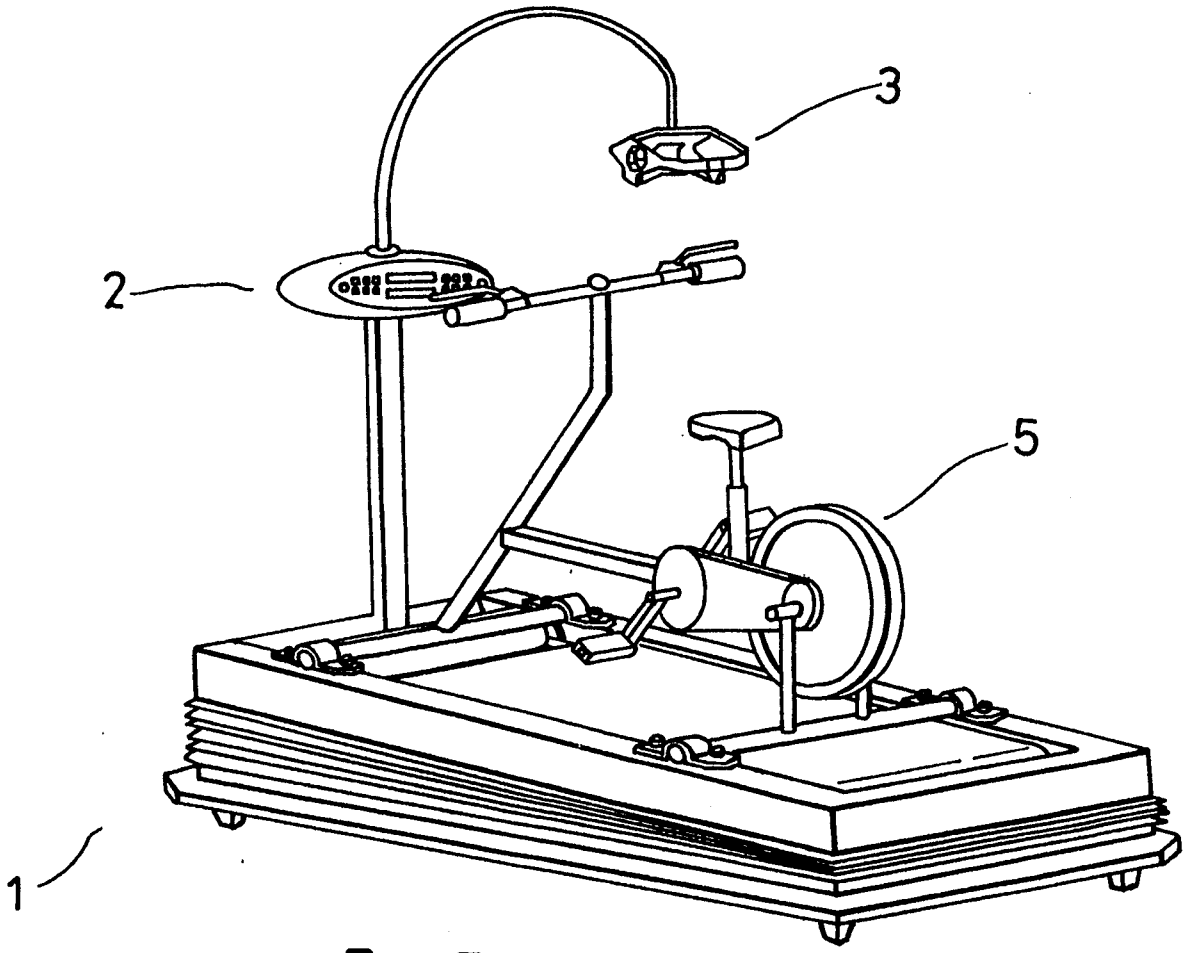

FIG. 7 shows a conventional pedaling bench fixed firmly on the base 1 of this running machine to make use of the visual-acoustic mask with the conventional pedaling bench, for pedaling under an on-the-spot condition coming from the screen 32 and the speakers 33 of the visual-acoustic mask 3.

While the preferred embodiments of the invention have been described above, it will be recognized and understood that various modifications may be made therein and the appended claims are intended to cover all such modifications which may fall within the spirit and scope of the invention.

What is claimed is:

1. A running machine, comprising:

a flat lower plate member having a rectangular contour;

an upper plate member disposed in spaced vertical relationship with said lower plate member;

a plurality of laterally extending roller shafts rotatively coupled to said upper plate member in spaced parallel relationship;

an endless belt disposed around said plurality of roller shafts;

a motor disposed adjacent a front portion of said upper plate member and drivingly coupled to at least one of said plurality of roller shafts for providing displacement of said endless belt thereon;

means for displacing said upper plate member relative to said lower plate member, said displacement means including four electrically operated lifts disposed between said upper plate member and said lower plate member, each of said lifts having a first end coupled to said lower plate member adjacent a respective corner thereof and having an opposing second end coupled to said upper plate member;

a bellows having one end encompassing a perimeter portion of said upper plate member and an opposing other end encompassing a perimeter portion of said lower plate member;

a computer electrically coupled to said motor and each of said four electrically operated lifts for controlling a speed of said motor and displacement of each of said lifts responsive to predetermined program; and, a visual-acoustic mask electrically coupled to said computer for providing visual and acoustic stimuli to a user, said visual-acoustic mask including a display screen for displaying images thereon and a pair of speakers for providing sounds associated with said images, wherein said computer coordinates changes in said lifts and motor with said images and said sounds to simulate a predetermined running environment.

* * * * *